US007125025B2

(12) United States Patent
Pascal

(10) Patent No.: US 7,125,025 B2
(45) Date of Patent: Oct. 24, 2006

(54) SNOWBOARD BINDING

(75) Inventor: Jean-Marc Pascal, Voreppe (FR)

(73) Assignee: Skis Rossignol S.A., Vioron (FR)

( * ) Notice: Subject to any disclaimer, the term of this patent is extended or adjusted under 35 U.S.C. 154(b) by 204 days.

(21) Appl. No.: 10/848,049

(22) Filed: May 19, 2004

(65) Prior Publication Data

US 2004/0232659 A1 Nov. 25, 2004

(30) Foreign Application Priority Data

May 20, 2003 (FR) ..... 03 06029

(51) Int. Cl.
*A63C 9/00* (2006.01)

(52) U.S. Cl. ..... 280/14.22; 280/14.24; 280/636

(58) Field of Classification Search ..... None
See application file for complete search history.

(56) References Cited

U.S. PATENT DOCUMENTS

| | | | | |
|---|---|---|---|---|
| 2,950,118 | A * | 8/1960 | Sharpe | 280/11.14 |
| 4,294,460 | A * | 10/1981 | Kirsch | 280/607 |
| 5,344,176 | A * | 9/1994 | Trimble | 280/602 |
| 5,503,900 | A * | 4/1996 | Fletcher | 428/160 |
| 5,765,854 | A * | 6/1998 | Moore et al. | 280/618 |
| 5,895,068 | A * | 4/1999 | Doyle | 280/618 |
| 5,971,407 | A | 10/1999 | Zemke et al. | |
| 6,328,328 | B1 * | 12/2001 | Finiel | 280/636 |
| 6,641,163 | B1 * | 11/2003 | Joubert des Ouches | 280/624 |
| 6,808,196 | B1 * | 10/2004 | Joubert Des Ouches | 280/636 |
| 6,991,240 | B1 * | 1/2006 | Grella et al. | 280/14.21 |
| 2001/0015542 | A1 | 8/2001 | Joubert Des Ouches | |

FOREIGN PATENT DOCUMENTS

| | | |
|---|---|---|
| WO | WO 03/030722 | 6/2000 |
| WO | WO 02/051510 A1 | 7/2002 |

* cited by examiner

*Primary Examiner*—Christopher P. Ellis
*Assistant Examiner*—Christopher Bottorff
(74) *Attorney, Agent, or Firm*—Browdy and Neimark, PLLC

(57) ABSTRACT

A snowboard binding (1), including a base plate (2) equipped on at least one of its front (12) or rear ends with a rigid plate (10), the upper face (11) of which is tilted upward and designed to receive the forces from the front or rear zones of the boot:

which includes a layer of elastomeric material (30) inserted between the base plate (2) and the plate (10);

wherein the layer of elastomeric material (3) has openings (31, 32) via which the plate (10) is rigidly fastened onto the base plate (2), coming into contact with the latter;

which includes apparatus (20–23) for longitudinally displacing the zone of contact between the plate (10) and base plate (2) via the openings (31, 32) in order to allow a plurality of longitudinal positions of the plate (10) relative to the base plate (2).

11 Claims, 1 Drawing Sheet

SNOWBOARD BINDING

The invention relates to the field of gliding sports, more particularly to that of snowboarding.

More specifically, it relates to an improvement to snowboard bindings, more precisely to bindings equipped, at the end of the base plate, with a riser commonly known as a gas pedal.

PRIOR ART

Generally speaking, it is known to equip the base plate of a snowboard binding with an element with an upper face that is tilted upward in order to match the rise of the boot sole and thus to allow good transmission of the forces exerted by the boot toe or heel.

In order to adapt to different sole curvatures, it was proposed, in document WO 00/30722, to articulate this plate relative to the base plate and thus to allow adjustment of its tilt.

An improvement of this principle was described in document FR 2 805 173, which makes it possible to adjust not only the tilt of the plate but also its longitudinal position, in order to adapt to different boot sizes. This type of plate generally has a downward lip at its front edge. This lip, which extends beyond the surface of the base plate, is designed to come into contact with the board in order to increase power transmission. However, when the binding is used for large-size boots, the plate is located in its extreme longitudinal position and thus projects a long way beyond the base plate. This causes a problem when the user makes turns during which the board is particularly tilted, as the plate may catch on the snow.

A solution to this problem was proposed, consisting in equipping the base plate with a metal plate of substantially constant thickness and curved upward, thus offering no lower lip. This plate is generally metallic so that it can offer sufficient stiffness to withstand the forces. However, the contact of the boot with this metal plate generally gives the user uncomfortable sensations.

A problem that the invention thus proposes to solve is that of improving the quality aspects of contact between the plate and the base plate while still retaining the possibility of longitudinal adjustment of the plate relative to the rest of the base plate.

SUMMARY OF THE INVENTION

The invention thus relates to a snowboard binding. A binding of this type includes, in a known manner, a base plate equipped on at least one of its front and/or rear end with a rigid plate. The upper face of this plate is tilted upward so as to receive the forces from the front and/or rear zones of the boot.

In accordance with the invention, this binding is defined in that it includes a layer of elastomeric material inserted between the base plate and the plate. This layer has openings via which the plate is rigidly fastened onto the base plate, coming into contact with the latter. Complementarily, the binding also includes means for longitudinally displacing the zone of contact between the plate and the base plate through the openings, in order to allow a plurality of longitudinal positions of the plate relative to the base plate.

Rigidly securing the plate and the base plate together allows very effective transmission of power to the board. Outside these zones of rigid contact, the layer of elastomeric material allows slight deformation of the plate and, in particular, a forward rocking movement that causes the plate to become compressed. The rocking movement thus allows slight deformation of the binding, which it is possible to feel particularly during frontside turns. It is important to note that this deformation capability is obtained in addition to excellent power transmission via the rigid contact zones. Similarly, this combination of effective power transmission capability and comfort flexibility is obtained while still retaining the possibility of longitudinal adjustment of the rigid plate.

In a particular embodiment, the layer of elastomeric material may be embedded in a housing made in the upper face of the base plate.

In practice, the contact between the base plate and the plate may be obtained via zones that protrude relative to the base plate, extending upward via openings in the layer of elastomeric material. However, in other variant embodiments, this contact may be achieved by means of supplementary rigid elements—forming a spacer—interposed between the plate and the base plate.

Advantageously, in practice, the openings made in the layer of elastomeric material are longitudinally elongate and also receive protruding zones that are therefore also elongate in order to allow the longitudinal displacement of the zone of contact between the plate and the base plate.

In a particular embodiment, the upper face of the plate may be located in the continuation of the upper face of the base plate, located just to the rear of the plate (or to the front, in the case of the rear gas pedal) . In this way, the upper face of the binding, comprising, therefore, the base plate and the plate, is continuous, forming no excess thickness which would be felt through the boot sole.

In a particular embodiment, the layer of elastomeric material may include a zone forming a rib inserted between the rear of the plate and the base plate or the front of said plate in the case of a rear gas pedal.

BRIEF DESCRIPTION OF THE FIGURES

The implementation of the invention and the advantages arising therefrom will become clearly apparent from the following description of the embodiment, supported by the appended figures, in which.

IMPLEMENTATION OF THE INVENTION

As already stated, the invention relates to a snowboard binding equipped with a rigid plate mounted on the base plate via the insertion of a special layer of elastomeric material. In the remainder of the description, the rigid plate fitted in accordance with the invention is a front plate, but it goes without saying that the same arrangements may be encountered regarding a rear plate, also.

Figure 1:
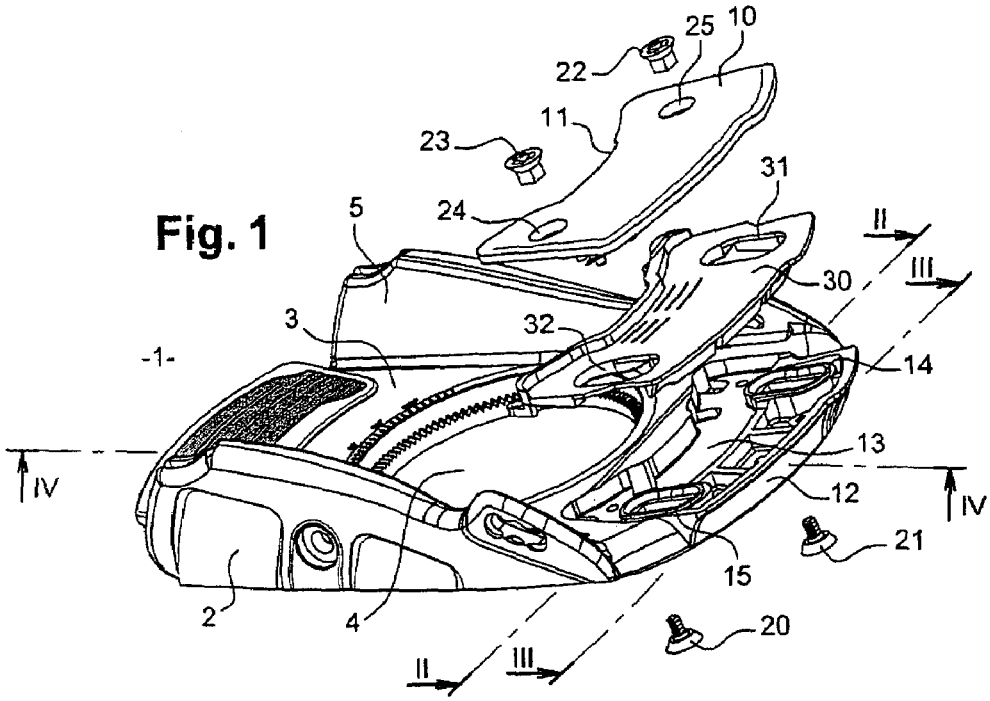
FIG. 1 is a basic perspective view of a binding produced in accordance with the present invention, shown in a dismantled configuration.

Thus, the binding (1) partially illustrated in FIG. 1 includes a base plate (2) with a central portion (3) designed to come into contact with the board and perforated with an opening (4) designed to receive a disk for rotational adjustment and fixing. The spoiler extending from the sides (5) has not been shown in order to make it easier to see the essential elements of the invention.

In the front part, the base plate (2) receives a plate (10). This plate (10) is produced from a rigid material and, for example, from a metallic material, and typically from aluminum, or even from a composite material. Although not genuinely relevant to the invention, it has ribs or reliefs on its upper face to guarantee that the boot grips well. The upper face (11) of the plate (10) is slightly tilted upward, as may be seen from FIG. 4, in order to allow the boot toe to grip.

In the embodiment illustrated, the front part (12) of the base plate (2) has a housing (13) that is hollow in its thickness. This housing (13) has a protruding zone (14, 15) on each side. These protruding zones are longitudinally elongate and perforated in order to receive the fastening screws (20, 21) that interact with nuts (22, 23) positioned in openings (24, 25) in the plate. These screw/nut assemblies lock the plate (10) onto the base plate (2). The apertures made in the protruding zones (14, 15) have notches or equivalent means to allow positioning of the screws at different longitudinal points. This arrangement allows longitudinal displacement of the plate, depending on the boot size. Naturally, the invention also covers variant embodiments in which the plate is locked onto the base plate by locking members that can be opened manually and manipulated without tools.

According to a characteristic of the invention, the housing (13) receives a layer made from an elastomeric material (30) that may advantageously have viscoelastic properties to guarantee vibration damping. For example, it is possible to use thermoplastic elastomer materials, optionally filled, and particularly styrene/ethylene-butylene/styrene (SEBS). This layer of elastomeric material (30) has openings (31, 32) that allow the protruding zones (14, 15) of the base plate to pass through. Via these openings (31, 32), these protuberances come into contact with the lower face of the plate (10) and, more particularly, with stamped zones (35, 36) produced in order to receive the nuts (22, 23). These stamped zones (35, 36) come into direct contact with the protruding zones (14, 15) in order to guarantee good transmission of the forces exerted by the rider. It will be noted that the protuberances (14, 15, 35, 36) formed on the base plate and on the plate (10) may be replaced by an element forming a spacer, making it possible to guarantee rigidity of the link between the gas pedal (10) and the base plate (2).

Figure 2:
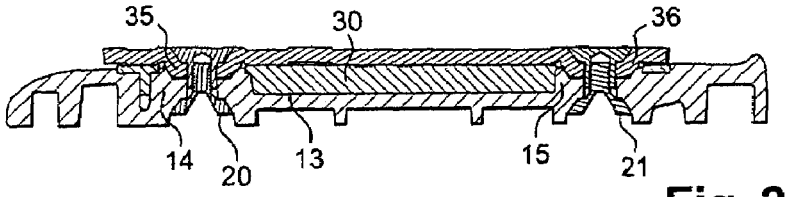
FIG. 2 is a view in transverse section in the region of the locking screws, in plane II—II of FIG. 1.
Figure 3:
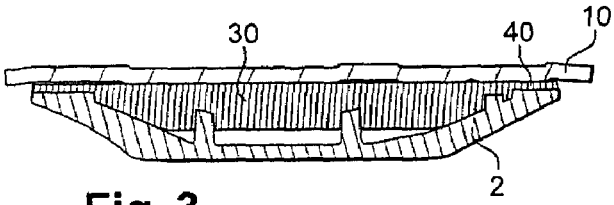
FIG. 3 is a transverse view of the binding of FIG. 1, in the plane III—III.
Figure 4:
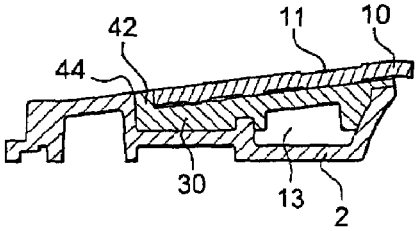
FIG. 4 is a view in median longitudinal section of the binding in FIG. 1.

After assembly, and as seen in FIGS. 2 to 4, the contact between the plate forming the gas pedal (10) and the base plate is a direct contact at the location of the abovementioned protuberances, as emerges from FIG. 2. Power is thus transmitted particularly effectively.

Furthermore, further in front of the screws (20, 21) and as illustrated in FIG. 3, a portion (40) of the layer of elastomeric material (30) is inserted between the base plate (2) and the gas pedal (10). Owing to the compression or deformation capability of the layer (30), this means that the gas pedal has a degree of freedom to pivot relative to the axis formed by the two points of contact at the screws (20, 21). This compression and vibration-damping capability results in greater comfort for the rider, particularly when he/she exerts pressure during frontside turns, i.e. when applying pressure to the front edges.

As illustrated in FIG. 4, a portion of the rib (42) of the elastomeric layer (30) appears between the rear edge (43) of the gas pedal (10) and the rear limit of the housing (13), corresponding to the visible edge (44) of the base plate, to the rear of the gas pedal (10). This portion (42) that forms a rib makes it possible slightly to damp longitudinal impacts on the gas pedal and also provides an aesthetic advantage, drawing attention to the damping property of the characteristic elastomeric plate. This rib also makes it possible to limit the risks of the boot's sliding forward when being fitted into the binding.

From the aforesaid it emerges that the binding in accordance with the invention offers multiple advantages, in particular:

- it allows longitudinal adjustment of the gas pedal without generating a risk of catching in the snow in the event of a turn with a high degree of lean;
- it allows very effective transmission of the forces exerted on the gas pedal toward the base plate via the rigid contact zone;
- it allows a slight, controlled pivoting of the gas pedal relative to a transverse axis, thereby improving comfort and feel for the user;
- it allows damping of vibration that could be transmitted between the gas pedal and the base plate.

The invention claimed is:

1. A snowboard binding (1), including a base plate (2) equipped on at least one of its front (12) or rear ends with a rigid plate (10), the upper face (11) of which is tilted upward and designed to receive the forces from the front or rear zones of the boot:

- which includes a layer of elastomeric material (30) inserted between the base plate (2) and said plate (10);
- wherein said layer of elastomeric material (3) has openings (31, 32) via which the plate (10) is rigidly fastened onto the base plate (2), coming into contact with the latter;
- which includes an assembly (20–23) between the plate (10) and the base plate (2) fastened through said openings (31, 32) which permit selection and fixing a plurality of longitudinal positions of the plate 910) relative to the base plate (2).

2. The snowboard binding as claimed in claim 1, wherein the layer of elastomeric material (30) is embedded in a housing (13) made in the upper face of the base plate (2).

3. The snowboard binding as claimed in claim 1, wherein the base plate (2) includes protruding zones (14, 15) extending upward via the openings (31, 32) in the layer of elastomeric material (30).

4. The snowboard binding as claimed in claim 1, wherein said openings (31, 32) are longitudinally elongate and receive protruding zones (14, 15) that are also elongate in order to allow the selection and fixing of the longitudinal positions of the plate (10) relative to the base plate (2).

5. The snowboard binding as claimed in claim 1, wherein the upper face (11) of the plate (10) is located in a continuation of the upper face of the base plate (2) located above said plate.

6. The snowboard binding as claimed in claim 1, wherein the layer of elastomeric material (30) includes a zone (42) forming a rib inserted between the rear of the plate (10) and the base plate (2).

7. A snowboard binding (1), including a base plate (2) equipped on at least one of its front (12) or rear ends with a rigid plate (10), the upper face (11) of which is tilted upward and designed to receive the forces from the front or rear zones of the boot:

which includes a layer of elastomeric material (30) inserted between the base plate (2) and said plate (10);

wherein said layer of elastomeric material (3) has openings (31, 32) via which the plate (10) is rigidly fastened onto the base plate (2), coming into contact with the latter;

which includes an assembly (20–23) between the plate (10) and the base plate (2) fastened through said openings (31, 32) which permit selection and fixing a plurality of longitudinal positions of the plate 910) relative to the base plate (2);

wherein said openings (31, 32) are longitudinally elongate and receive protruding zones (14, 15) that are also elongate in order to allow the selection and fixing of the longitudinal portions of the plate (10) relative to the base plate (2).

8. The snowboard binding as claimed in claim 7, wherein the layer of elastomeric material (30) is embedded in a housing (13) made in the upper face of the base plate (2).

9. The snowboard binding as claimed in claim 7, wherein the base plate (2) includes protruding zones (14, 15) extending upward via the openings (31, 32) in the layer of elastomeric material (30).

10. The snowboard binding as claimed in claim 7, wherein the upper face (11) of the plate (10) is located in a continuation of the upper face of the base plate (2) located above said plate.

11. The snowboard binding as claimed in claim 7, wherein the layer of elastomeric material (30) includes a zone (42) forming a rib inserted between the rear of the plate (10) and the base plate (2).

* * * * *